US007344046B1

(12) United States Patent
Larson et al.

(10) Patent No.: US 7,344,046 B1
(45) Date of Patent: Mar. 18, 2008

(54) SPACERLESS OR GEOCOMPOSITE DOUBLE BOTTOM FOR STORAGE TANK

(75) Inventors: Tor Frederick Larson, West Chester, PA (US); Kenneth Leland Erdmann, Tulsa, OK (US)

(73) Assignee: Matrix Service, Inc., Tulsa, OK (US)

( * ) Notice: Subject to any disclaimer, the term of this patent is extended or adjusted under 35 U.S.C. 154(b) by 271 days.

(21) Appl. No.: 10/717,405

(22) Filed: Nov. 19, 2003

(51) Int. Cl.
*B65D 90/02* (2006.01)

(52) U.S. Cl. ..... 220/565

(58) Field of Classification Search ..... None
See application file for complete search history.

(56) References Cited

U.S. PATENT DOCUMENTS 4,513,550 A * 4/1985 Kotcharian ..... 52/745.01
4,598,005 A * 7/1986 Ziegenbein ..... 428/69
4,640,853 A 2/1987 Schmeal et al. ..... 428/35
4,871,081 A 10/1989 Ershig ..... 220/5
4,939,833 A * 7/1990 Thomas ..... 220/565
5,002,195 A 3/1991 Lasson ..... 220/5
5,261,764 A * 11/1993 Walles ..... 405/52
5,269,173 A 12/1993 Henneck et al. ..... 73/49.2
5,269,436 A 12/1993 Bachmann ..... 220/469
5,522,340 A 6/1996 Skogman ..... 114/357
5,816,424 A 10/1998 Cannan, Jr. et al. ..... 220/4.12
6,145,690 A * 11/2000 Dhellemmes et al. .. 220/560.07
6,206,226 B1 3/2001 Coates ..... 220/565
6,431,387 B2 8/2002 Piehler ..... 220/495.01

* cited by examiner

*Primary Examiner*—Stephen J. Castellano
(74) *Attorney, Agent, or Firm*—Head, Johnson & Kachigian

(57) ABSTRACT

A spacerless double bottom apparatus for a storage tank having a metal bottom and upwardly extending metal sidewalls. The apparatus includes a first lining layer of flexible plastic on top of the metal bottom. A plastic grid having a plurality of openings therethrough is installed on top of the first lining layer. At least one layer of fiber insulation is installed and resides on top of the grid. An upper metal bottom on top of the fiber insulation is welded to the sidewalls to form a fluid tight secondary containment compartment.

13 Claims, 4 Drawing Sheets

SPACERLESS OR GEOCOMPOSITE DOUBLE BOTTOM FOR STORAGE TANK

BACKGROUND OF THE INVENTION

1. Field of the Invention

The present invention is directed to a spacerless double bottom apparatus for a metal storage tank and a method of installation thereof. In particular, the present invention is directed to a spacerless double bottom apparatus that occupies a minimum of space in a metal storage tank.

2. Prior Art

In large storage tanks, such as those used for fluid hydrocarbon including oil and gas, the metal bottom of the storage tank may be subject to corrosion over time. The bottom may corrode for a number of service conditions and may corrode from the inside or from the outside.

It is possible to completely remove the corroded bottom and replace it with another replacement bottom although this is time consuming, expensive and does not address possible underside corrosion. Rather than replace the bottom of the tank, a practice has been developed in servicing of large storage tanks to add a new bottom parallel to and spaced from the existing bottom. In one existing practice, new bottom plates are added and welded to the sidewalls after inserting approximately four inches of sand on top of the old bottom. While this practice works to create a fluid-tight storage tank container, four to six vertical inches of the storage tank are lost in the process. Additionally, in the event that a leak develops through the new, upper bottom, while the sand may absorb some of the fluid, it will be difficult to determine when a leak has developed. In another existing practice, a second metal bottom is placed on top of a rebar grid inserted on top of the original bottom plate. The rebar grid acts as a spacer and allows fluid flow.

In another existing practice, a plastic liner is placed over the corroded bottom. Any welding near the plastic liner, however, will damage the liner.

Industry standards, such as API (American Petroleum Institute) 650 and 653, require each tank to have a nozzle or nozzles with reinforcing around the nozzle a certain distance from the tank bottom due to weld spacing limitations. If the secondary tank bottom is spaced too far from the original bottom, the nozzle will have to be relocated.

Other prior attempts to address these issues include Ershig (U.S. Pat. No. 4,871,081) which discloses a multi-layer floor for primary and secondary containment having: a lower floor 4 which includes a plastic sheet 6, a fiberglass reinforced plastic exterior 8, and an interior vertically oriented grating 10; and an upper floor 24 which includes an upper element 26, a lower element 28 and interior grating 30. Ershig is directed to a new double wall tank system using sandwich panels.

Lasson (U.S. Pat. No. 5,002,195) discloses a double-walled tank bottom including an outer shell bottom 12 and an inner shell bottom 14 spaced therefrom with a formed plastic sheet 60 in the gap 71. The plastic sheet has bosses 61 and depressions 59 and spaced support steel balls in selected depressions. Lasson requires rigid support on both sides of a liner which would not retrofit well where the existing bottom is deformed.

Henneck et al. (U.S. Pat. No. 5,269,173) discloses a bitumen layer applied on top of an outer tank bottom 10 covered by polyethylene film. A liquid permeable layer 16, such as drainage asphalt, is applied on top of the film with sensor cable 18 therein. An inner tank floor 28 is welded above the permeable layer 16.

Bachmann (U.S. Pat. No. 5,269,436) discloses a double walled tank with an outer wall and an inner wall. The inner wall is formed of a laminate comprising an embossed aluminum foil sheet 25 and a plastic layer 27. Bachmann utilizes foil and glass with epoxy which is not compatible with the heat of welding.

Skogman (U.S. Pat. No. 5,522,340) discloses a double walled vessel such as a tank including a first wall 32 spaced apart from a second outer wall 33 with an intermediate single woven member 34 therebetween. The woven member 34 has a plurality of longitudinally extending cylindrical members 36 positioned parallel to each other and a plurality of fibers 38 woven perpendicularly to the cylindrical members. Skogman is directed to a non-metallic tank.

Coates (U.S. Pat. No. 6,206,226) discloses a series of fiber reinforced plastic panels joined together by pop rivets to form an inner wall with an open grid of high density polyethylene between the inner plastic panels and the outer wall. Coates does not provide a metal retrofit bottom.

Piehler (U.S. Pat. No. 6,431,387) discloses in FIG. 3 a lining system with a plastic foil placed on a tank bottom 1 and a plastic grid and foil resting thereon.

Nevertheless, there remains a need to provide a double bottom apparatus for a large storage tank which is extremely thin and takes up a minimum amount of volumetric space in the storage tank.

There also remains a need to provide a spacerless double bottom apparatus for a large storage tank which includes a fluid tight sealed compartment for secondary containment which will contain any future leaks.

There also remains a need to provide a spacerless double bottom apparatus having a fluid tight sealed secondary containment compartment which may be negatively or positively pressurized.

There also remains a need to provide a spacerless double bottom apparatus which utilizes a thin sheet of plastic liner and, at the same time, utilizes an upper metal bottom that will be welded to the existing sidewalls of a storage tank without damage to the plastic liner.

There also remains a need to provide a spacerless double bottom apparatus for field retrofitting to an existing storage tank which may be simply installed.

There also remains a need to provide a spacerless double bottom apparatus which utilizes a plastic liner, a plastic grid to permit fluid flow, and a metal replacement bottom which minimizes any need for overhead welding.

There also remains a need to purge a sealed interstitial space with an inert gas or corrosion inhibitor to prevent corrosion.

There also remains a need to install a secondary containment liner in a tank storing a heated product without melting the liner.

There also remains a need to install a third bottom without greatly reducing capacity.

There also remains a need to create a closed interstitial space so as to be able to create a positive pressure differential for tracer gas (such as helium) detection of leaks.

There also remains a need to install a corrosion probe in the interstitial space to monitor corrosive activity.

There also remains a need to provide a double bottom apparatus capable of transmitting force from fluid in the tank to the underlying ground while maintaining flexibility.

SUMMARY OF THE INVENTION

The present invention is directed to a spacerless double bottom apparatus and method for a storage tank having a flat metal bottom with upstanding cylindrical sidewalls.

Initially a bottom cut will be made around the circumference of the storage tank parallel to the original bottom. In some instances, an additional cut will be made above and parallel to the bottom cut to leave an open slot or gap around the circumference of the storage tank.

A flat bar or bars having a radiused inner edge will be welded to the outside sidewalls, perpendicular to the sidewall.

Thereafter, a first lining layer of flexible plastic will be laid on top of the metal bottom. The lining layer may be held in place by a plurality of fasteners and washers which penetrate the lining layer and go into the original bottom. An initially liquid sealant may be applied around the edge of the original bottom and the lower portion of the sidewalls. The sealant cures to form a solid, fluid-tight seal between the lining layer and the sidewall.

Thereafter, notches would be made through the sidewalls of the storage tank in order to install a square bar with drilled holes and attached nipples through the sidewalls. A clear cap of plastic or other material would be installed on the ends of the nipples to act as a visual leak detection port in a closed system.

A plastic grid having a plurality of openings thereto is laid on top of the first lining layer. On top of the plastic grid, two layers of fiber insulation material, such as materially bonded mineral or glass wool, will be placed. The material acts not only as a spacer but as an insulator to keep any heat generated from welding from damaging or melting the grid or the lining layer.

Thereafter, a series of metal plates are installed on top of the mineral wool layers so that the edges of the metal plates extend through the slot outside of the sidewalls. The metal plates are joined together by welding to form an upper metal bottom.

The lower side of the upper metal bottom will rest on the flat bar. Welds may be employed between the upper bottom and the sidewalls and between the upper bottom and the flat bar.

The apparatus thereby creates a fluid-tight secondary containment space between the upper bottom, the sidewalls, and the lining layer which is on top of the original bottom. The leak detection ports are of clear material, capped, the connections are sealed.

DETAILED DESCRIPTION OF THE PREFERRED EMBODIMENTS

The embodiments discussed herein are merely illustrative of specific manners in which to make and use the invention and are not to be interpreted as limiting the scope of the instant invention.

While the invention has been described with a certain degree of particularity, it is to be noted that many modifications may be made in the details of the invention's construction and the arrangement of its components without departing from the spirit and scope of this disclosure. It is understood that the invention is not limited to the embodiments set forth herein for purposes of exemplification.

Figure 1:
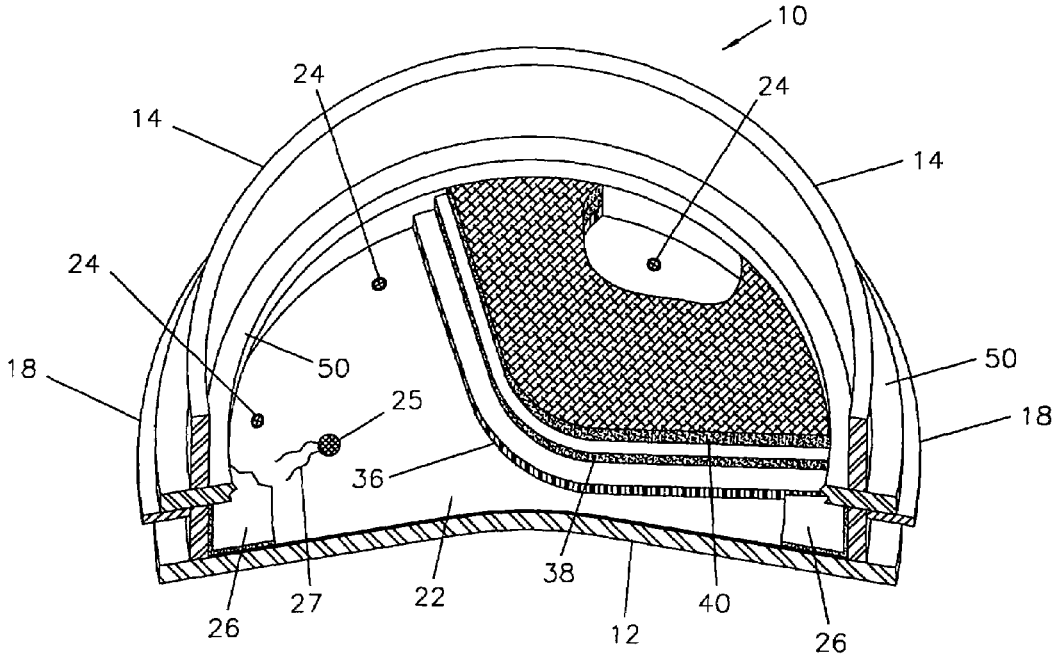
FIG. 1 illustrates a perspective view of a spacerless double bottom apparatus with portions cut away constructed in accordance with the present invention.
Figure 2:
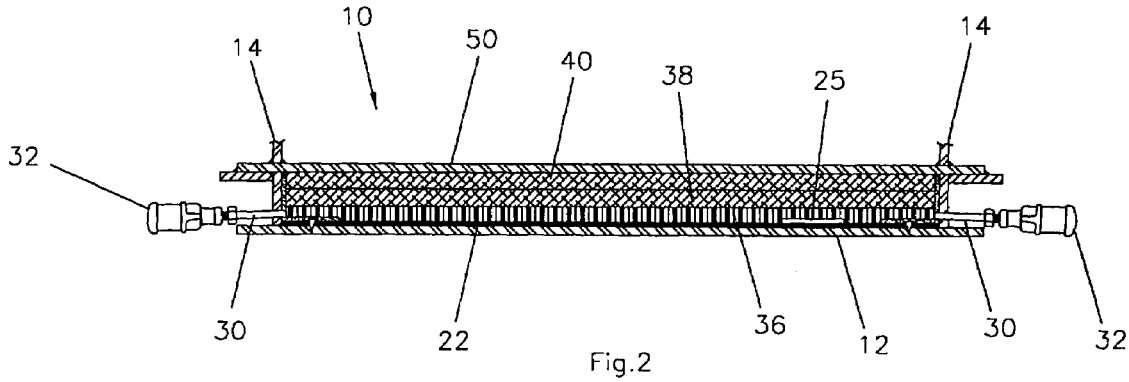
FIG. 2 illustrates a sectional view of the spacerless double bottom apparatus shown in FIG. 1.

FIG. 1 illustrates a perspective view of a spacerless double bottom apparatus with portions cut away for clarity, and FIG. 2 illustrates a sectional view of a spacerless double bottom apparatus for a storage tank constructed in accordance with the present invention. The present invention may be applied to a new tank construction or, alternatively as will be described in a preferred embodiment herein, to existing storage tanks.

As shown in FIGS. 1 and 2, a storage tank would typically include a flat, metal bottom 12 with upstanding cylindrical sidewalls 14 (only portions shown in FIGS. 1 and 2).

To install the apparatus 10, initially, a bottom cut will be made around the circumference of the storage tank by welding through the tank sidewall 14. In one case, the bottom cut will be parallel to the original bottom 12 and will be approximately 1" above the level of the original bottom. As an option, an additional cut will be made above and parallel to the bottom cut. In one example, the top cut will be made ¾" above the bottom cut entirely around the circumference of the storage tank. This will leave an open slot around the circumference of the storage tank, as best seen in FIG. 3.

The sidewalls of the tank may be held in place by wedges, logs, hangers, or other devices so the open slot or gap is maintained.

Figure 3:
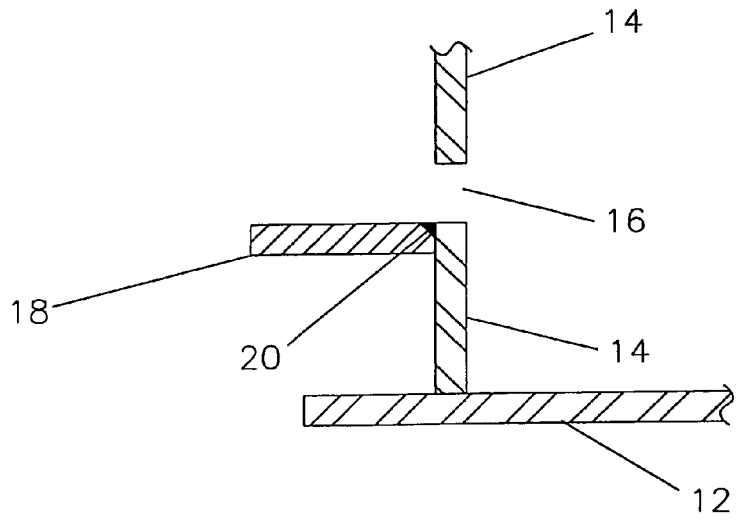
FIG. 3 illustrates a part of the procedure to install a spacerless double bottom apparatus in accordance with the present invention.

As best seen in FIG. 3, once the slot or gap 16 has been made in the sidewalls 14, a flat bar or bars 18 which will have a radiused inside edge, will be welded to the outside of the sidewalls 14. The flat bar or bars 18 will be perpendicular to the sidewalls 14. In the embodiment shown, the inner edge of the flat bar 18 will have a chamfer so that a weld 20 will not extend beyond the level of the flat bar or extend into the slot 16.

Thereafter, a first lining layer of flexible plastic or coating 22 will be laid or sprayed on top of the metal bottom 12. The lining layer 22 is visible in the cut-away view shown in FIG. 1. In one preferred embodiment, the first lining layer 22 is composed of a high density polyethylene sheet having a thickness of approximately 60 mm to 80 mm. The first lining layer 22 will be laid down across the entire bottom 12 and up to the corner where the original bottom 12 meets the sidewalls 14. As an optional procedure, the lining layer 22 may be held in place by a plurality of fasteners and washers 24 which will penetrate the lining layer 22 and go into the original bottom 12.

A sealant which is applied initially in liquid form and thereafter cures to a solid, may be applied around the edge of the original bottom and the lower portion of the sidewalls. The sealant cures to form a fluid tight seal between the lining layer and the sidewall. The sealant 26, in one case sold under a brand name of Elastuff Mastic™ may be seen in cured form in FIG. 1.

A known corrosion probe 25 having an extending wire or wires 27 may also be installed.

Thereafter, as seen in FIG. 2, notches will be made through the sidewalls 14 of the storage tank in order to install a square bar with drilled holes and nipples 30 through the sidewalls 14. A clear cap of plastic or other material will be installed on the ends of the nipples 30 at a later time to act as a leak detection port. In one preferred embodiment, the caps 32 will be comprised of a clear polyvinyl chloride (PVC).

Thereafter, a plastic grid 36 having a plurality of openings therethrough is laid on top of the first lining layer 22. The plastic grid may be composed of high density polyethylene such as net material sold under the brand name of GEO-NET™. As will be seen, fluid passes easily therethrough.

On top of the plastic grid 36, two layers of fiber insulation material will be placed. In the present embodiment, mechanically bonded mineral wool layers 38 and 40 are utilized.

Figure 5:
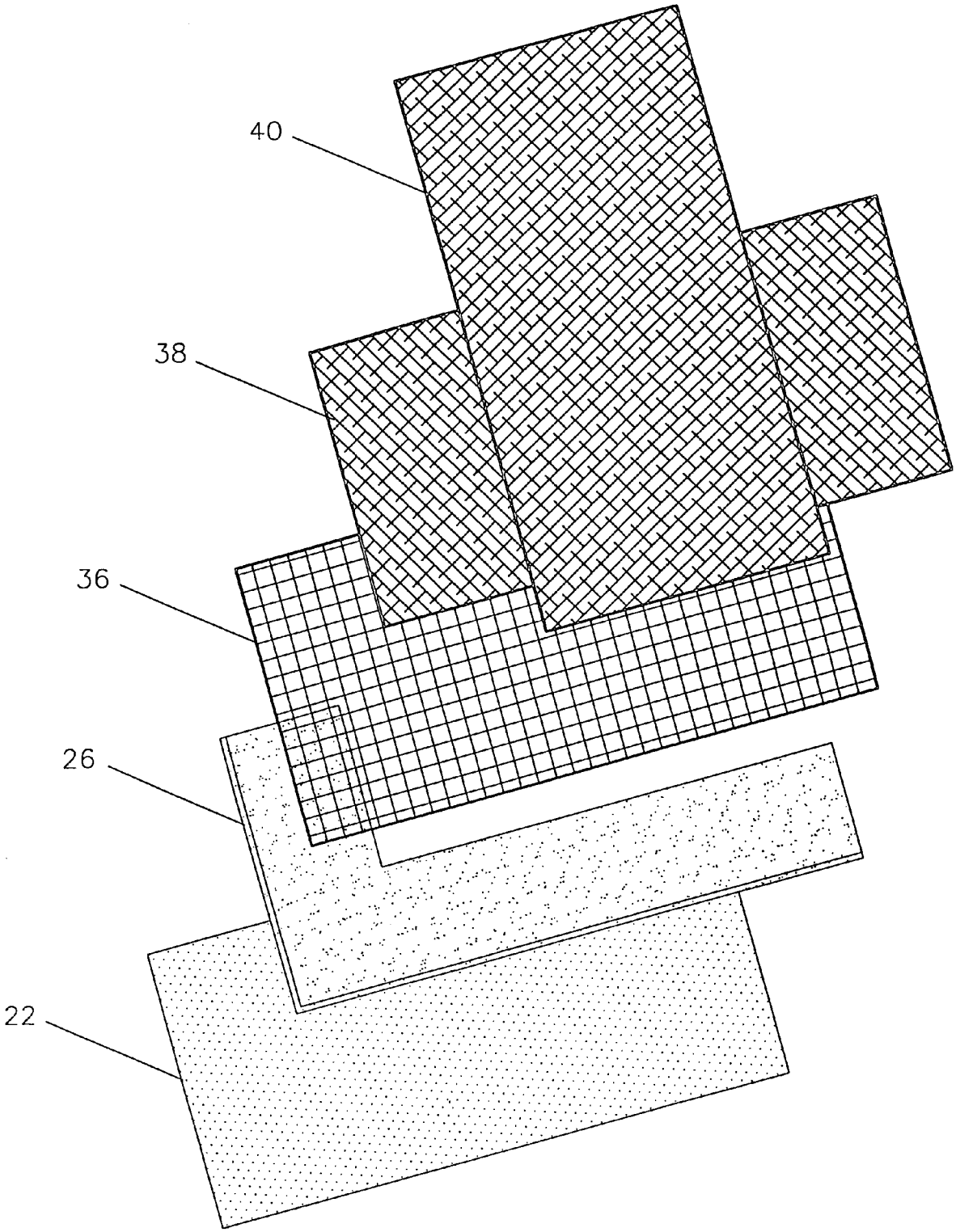
FIG. 5 illustrates an exploded view of portions of the elements utilized in the spacerless double bottom apparatus of the present invention.

In one preferred embodiment, the fiber insulation material 38 and 40 is supplied in rolls so that a first mineral wool layer 38 would be rolled out in one direction and a second layer 40 will be rolled out in a second direction as best seen in the exploded view in FIG. 5. This procedure reduces the likelihood of any gaps or hot spots in the layers of wool. The wool is a non-flammable fibrous wool-like material made from a mixture of stone, slag or glass and is sometimes known as rock wool, fiberglass, or slag wool. Alternate types of fiber insulation might be employed within the spirit and scope of the present invention. The wool is not only a spacer but an insulator to keep any heat generated from welding from damaging or melting the grid 36 or the lining layer 22.

The wool also maintains the integrity of the liner maintaining the vapor free environment. Finally the wool protects the liner from future repairs.

Thereafter, a series of metal plates are installed on top of the wool layers with the edges of the metal plates extending through the slot 16 outside of the sidewalls 14. In one preferred embodiment, a series of rectangular metal plates are utilized. The series of metal plates will be joined together by welding to form an upper metal bottom 50.

Figure 4:
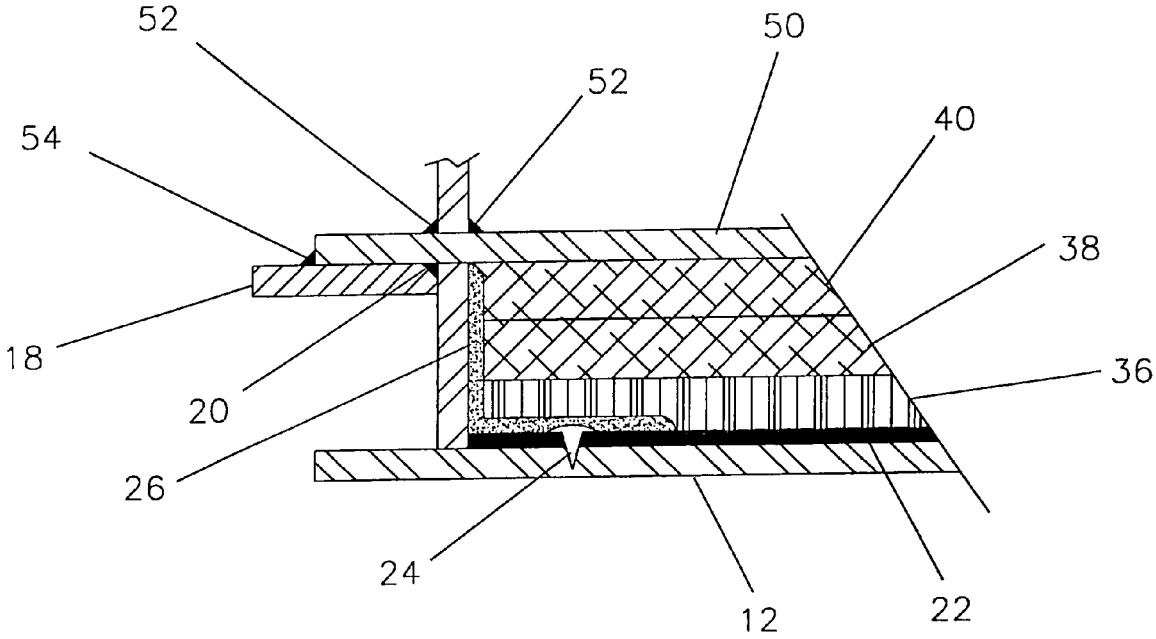
FIG. 4 illustrates an enlarged portional sectional view of the spacerless double bottom apparatus constructed in accordance with the present invention.

The lower side of the upper metal bottom 50 will rest on the flat bar 18 as best seen in the enlarged, sectional view in FIG. 4. Thereafter, welds may be employed between the upper bottom 50 and the sidewalls 14 shown at welds 52 and an additional weld may be employed between the upper bottom 50 and the flat bar 18 shown at weld 54. It will be observed that a fluid tight connection is thereby made between the new upper bottom 50 and the sidewalls without the necessity of welding underneath the upper bottom.

The apparatus 10 thereby creates a fluid tight secondary containment space between the upper bottom 50, the sidewalls 14, and the lining layer 22 which is on top of the original bottom 12. In the event of a future leak through the upper bottom, any fluid will flow into the secondary containment space, will pass through the openings in the grid 36 so that fluid will reside in the clear tube or tubes 32 extending from nipple or nipples 30.

As the secondary containment space is fluid tight, it will also be possible to purge the secondary containment space of oxygen such as by purging with nitrogen or other inert gas using the nipples 30 and caps 32 previously described. This will also assist in reducing oxidation or any effects of oxidation in the secondary containment space. Additionally, the secondary containment space may be positively or negatively pressurized.

The entire spacerless double bottom apparatus will take up no more than one inch (1") of vertical space in the tank.

FIG. 5 illustrates an exploded view of components which are utilized in the spacerless double bottom apparatus including the first liming layer 22, the sealant 26 which cures to form a solid, the plastic grid 36, and the mineral wool layers 38 and 40.

Figure 6:
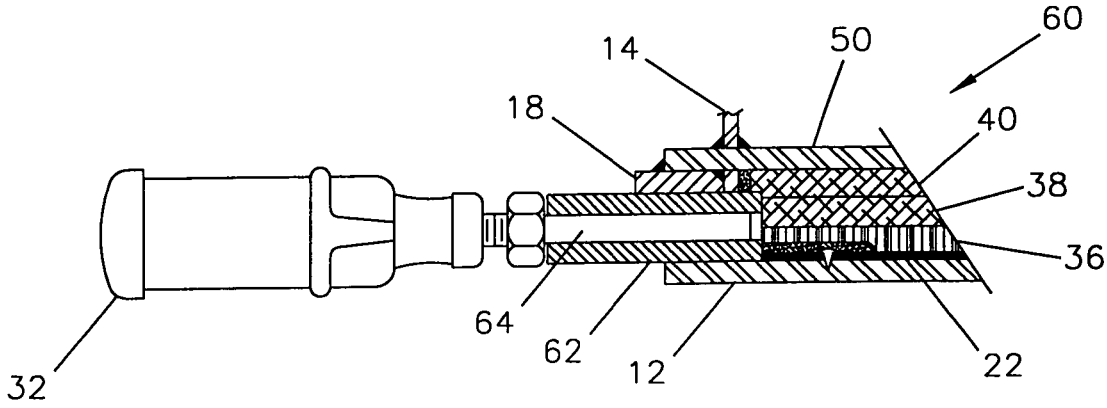
FIGS. 6 and 7 illustrate an alternate embodiment of the spacerless double bottom apparatus.
Figure 7:
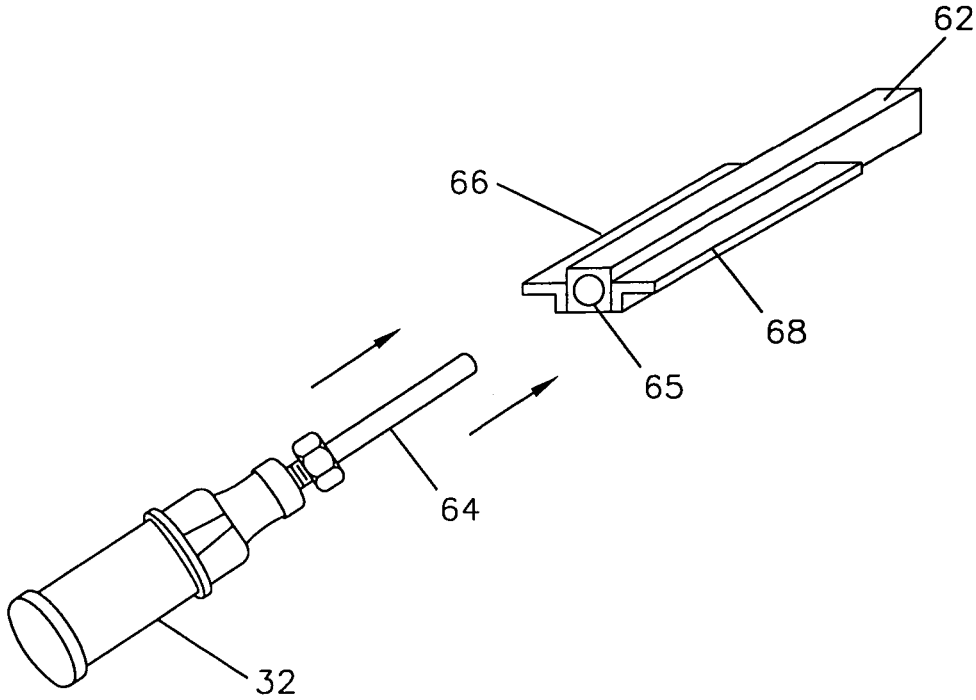

FIGS. 6 and 7 show an alternate embodiment of the apparatus 60 having a rectangular bar 62 penetrating the sidewall 14 with a nipple 64 residing in a cylindrical opening 65 therethrough. On each side of the rectangular tube 62 is a shelf 66 and 68 which may be welded to the rectangular tube 62 and act as a platform or shelf for the radiused flat bar 18 welded to the outside of the sidewall.

Among other advantages, the lining layer blocks product vapor from product that had leaked through the original bottom and prevent it from causing a flammable environment in the tank that would prevent welding.

Whereas, the present invention has been described in relation to the drawings attached hereto, it should be understood that other and further modifications, apart from those shown or suggested herein, may be made within the spirit and scope of this invention.

What is claimed is:

1. A spacerless or geocomposite double bottom apparatus for a storage tank having a metal bottom and upwardly extending metal sidewalls, which apparatus comprises:

a first lining layer of flexible plastic on top of said metal bottom;

a plastic grid having a plurality of openings therethrough on top of said first lining layer;

at least one layer of fiber insulation on top of said grid; and an upper metal bottom on top of said fiber material welded to said sidewalls wherein said upper bottom extends through slots in said sidewalls and is welded thereto by welding to a flat bar extending from said sidewalls.

2. A double bottom apparatus as set forth in claim 1 wherein said first lining layer is a high density polyethylene sheet.

3. A double bottom apparatus as set forth in claim 1 wherein said plastic grid is composed of high density polyethylene.

4. A double bottom apparatus as set forth in claim 1 wherein said fiber insulation is mechanically bonded mineral or glass wool.

5. A double bottom apparatus as set forth in claim 4 including two layers of said mechanically bonded mineral or glass wool.

6. A double bottom apparatus as set forth in claim 1 wherein all welds are made from above said upper bottom.

7. A double bottom apparatus as set forth in claim 1 including a leak detection port through said sidewalls between said original bottom and said upper bottom.

8. A double bottom apparatus as set forth in claim 6 wherein said leak detection port includes a clear cylindrical tube so that fluid therein is visible.

9. A double bottom apparatus as set forth in claim 1 wherein a fluid tight containment space is created between said upper bottom, said sidewalls, and said first lining layer.

10. A double bottom apparatus as set forth in claim 9 wherein said fluid tight containment space is purged of oxygen.

11. A double bottom apparatus as set forth in claim 10 wherein said lining layer is fastened to said metal bottom by a plurality of fasteners.

12. A double bottom apparatus for a storage tank as set forth in claim 1 including a sealant between said first lining and said sidewalls.

13. A spacerless or geocomposite double bottom apparatus for a storage tank having a metal bottom and upwardly extending metal sidewalls, which apparatus comprises:

a first lining layer of flexible plastic on top of said metal bottom;

a plastic grid having a plurality of openings therethrough on top of said first lining layer;

at least one layer of fiber insulation on top of said grid; and an upper metal bottom on top of said fiber material extending through slots in said sidewalls and welded thereto by welding to a flat bar extending from said sidewalls.

* * * * *